US007296657B2

(12) United States Patent
Ohno et al.

(10) Patent No.: US 7,296,657 B2
(45) Date of Patent: Nov. 20, 2007

(54) ENGINE EXHAUST MUFFLER WITH EXHAUST EMISSION CONTROL FUNCTION

(75) Inventors: Syuji Ohno, Saitama (JP); Shosaku Chiba, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 126 days.

(21) Appl. No.: 11/094,485

(22) Filed: Mar. 31, 2005

(65) Prior Publication Data

US 2005/0224284 A1 Oct. 13, 2005

(30) Foreign Application Priority Data

Apr. 7, 2004 (JP) ..... 2004-113392

(51) Int. Cl.

| | |
|---|---|
| ***F01N 1/08*** | (2006.01) |
| ***F01N 3/20*** | (2006.01) |
| *F01N 3/10* | (2006.01) |
| *F01N 3/28* | (2006.01) |
| *F01N 7/00* | (2006.01) |

(52) U.S. Cl. ..... 181/272; 181/269; 181/231; 60/299; 60/302; 60/322

(58) Field of Classification Search ..... 181/172, 181/269, 231; 60/299, 302, 322
See application file for complete search history.

(56) References Cited

U.S. PATENT DOCUMENTS

| | | | | |
|---|---|---|---|---|
| 4,628,689 | A | 12/1986 | Jourdan | |
| 4,848,513 | A * | 7/1989 | Csaszar | 181/265 |
| 5,218,817 | A * | 6/1993 | Urata | 60/274 |
| 5,440,083 | A * | 8/1995 | Masuda | 181/240 |
| 5,451,728 | A * | 9/1995 | Chandler et al. | 181/230 |
| 5,996,732 | A * | 12/1999 | Burger et al. | 181/230 |
| 6,250,422 | B1 * | 6/2001 | Goplen et al. | 181/272 |
| 6,393,835 | B1 | 5/2002 | Stoll et al. | |
| 2003/0173148 | A1 | 9/2003 | Andersson et al. | |
| 2005/0258001 | A1 * | 11/2005 | Ryczek et al. | 181/272 |

FOREIGN PATENT DOCUMENTS

| | | |
|---|---|---|
| JP | 5-141233 | 6/1993 |
| JP | 2618764 | 3/1997 |
| JP | 2004150328 A * | 5/2004 |

* cited by examiner

*Primary Examiner*—Edgardo San Martin
(74) *Attorney, Agent, or Firm*—Arent Fox LLP

(57) ABSTRACT

A muffler having a muffler body divided into first and second exhaust chambers by a partitioning member which has a third exhaust chamber formed therein. An exhaust inlet introduces exhaust gas from an engine into the first exhaust chamber. First communication bores provide communication between the first and second exhaust chambers, and second communication bores provide communication between the second exhaust chamber and the third exhaust chamber. The third exhaust chamber is open to the atmosphere through an exhaust outlet pipe. An exhaust emission control catalyst is carried on an outer surface of the partitioning member facing the first and second exhaust chambers, as well as on an inner surface of the partitioning member facing the third exhaust chamber. An inner surface of the muffler body does not carry the exhaust emission control catalyst.

5 Claims, 8 Drawing Sheets

ENGINE EXHAUST MUFFLER WITH EXHAUST EMISSION CONTROL FUNCTION

RELATED APPLICATION DATA

The Japanese priority application No. 2004-113392 upon which the present application is based is hereby incorporated in its entirety herein by reference.

BACKGROUND OF THE INVENTION

1. Field of the Invention

The present invention relates to an improvement in an exhaust muffler with an exhaust emission control function, which is utilized mainly in a general-purpose engine.

2. Description of the Related Art

Japanese Patent Application Laid-open No. 5-141233 discloses a conventional exhaust muffler with an exhaust emission control function, in which a porous carrier carrying an exhaust emission control catalyst is secured to an inner surface of a hollow muffler body. Also, Japanese Patent No. 2618764 discloses another conventional exhaust muffler with an exhaust emission control function, in which a honeycomb carrier or a porous carrier carrying an exhaust emission control catalyst is incorporated in an exhaust passage within a hollow muffler body.

In the exhaust muffler as disclosed in Japanese Patent Application Laid-open No. 5-141233, the porous carrier carrying the exhaust emission control catalyst is secured to the inner wall of the muffler body, and therefore the muffler body is overheated by exhaust gas purifying reaction heat generated in the exhaust emission control catalyst, resulting in a fear that thermal damages are provided to devices adjacent to the exhaust muffler. In addition, in the exhaust muffler as disclosed in Japanese Patent No. 2618764, not only the structure is complicated and costly, but also the temperature of the exhaust gas is steeply raised and a portion of the muffler body near or adjacent to the honeycomb carrier or the porous carrier is particularly overheated because the purification of an exhaust gas is conducted at one time on the honeycomb carrier or the porous carrier. Further, a slight loss in output is caused by an increase in back pressure in the engine due to the honeycomb carrier or the porous carrier. Therefore, this exhaust muffler is unsuitable for use, particularly, in a general-purpose engine having a relatively small displacement.

SUMMARY OF THE INVENTION

Accordingly, it is an object of the present invention to provide an exhaust muffler with an exhaust emission control function, wherein thermal damages to devices adjacent to the exhaust muffler are less; the structure is simple and inexpensive; and a loss in output from an engine is less.

To achieve the above object, according to a first feature of the present invention, there is provided an exhaust muffler with an exhaust emission control function, comprising: a hollow muffler body; a partitioning member dividing the inside of the muffler body into a first exhaust chamber and a second exhaust chamber; a third exhaust chamber formed in the partitioning member; an exhaust inlet provided in the muffler body so as to introduce exhaust gas from an engine into the first exhaust chamber; first communication bores provided in the partitioning member so as to provide communication between the first exhaust chamber and the second exhaust chamber; second communication bores provided in the partitioning member so as to provide communication between the second exhaust chamber and the third exhaust chamber; an exhaust outlet pipe permitting the third exhaust chamber to open to the atmosphere; and an exhaust emission control catalyst carried on an outer surface of the partitioning member facing the first and second exhaust chambers, as well as on an inner surface of the partitioning member facing the third exhaust chamber; an inner surface of the muffler body not carrying the exhaust emission control catalyst.

With the first feature of the present invention, the exhaust gas from the engine is subjected stepwise to purifying reactions on the outer and inner surfaces of the partitioning member, while being moved sequentially through the first to third exhaust chambers. Therefore, both the rise of the temperature of the exhaust gas and the rise of the temperature of the partitioning member itself due to purifying reaction heat can be minimized. Moreover, because the inner surface of the muffler body is formed as the surface which does not carry the exhaust emission control catalyst, it is possible to avoid the overheating of the muffler body to easily prevent a thermal damage to the adjacent devices. Furthermore, a honeycomb carrier or a porous carrier exclusively used for carrying the catalyst is not used, and hence it is possible to provide the exhaust muffler having a simple and inexpensive structure.

By appropriately setting the length of the exhaust outlet pipe corresponding to a normal rotational speed of the engine, the outside air can be drawn into the third to first exhaust chambers by effectively utilizing the pulsation of the exhaust gas from the engine, and therefore it is possible to provide an enhancement in exhaust gas purifying performance by an oxidizing reaction.

Further, the exhaust emission control catalyst carried on the outer and inner surfaces of the partitioning member little obstructs the flowing of the exhaust gas and hence, it is possible to suppress an increase in back pressure in the engine to prevent a loss in output from the engine to the utmost.

According to a second feature of the present invention, in addition to the first feature, a first diffusing plate is disposed in the first exhaust chamber so as to diffuse the exhaust gas flowing through the exhaust inlet into the first exhaust chamber.

With the second feature of the present invention, the exhaust gas flowing through the exhaust inlet into the first exhaust chamber can be diffused by the first diffusing plate over the entire first exhaust chamber and brought into contact with all over the outer surface of the partitioning member carrying the catalyst, whereby the exhaust gas can be effectively purified. Moreover, the exhaust gas flowing through the exhaust inlet into the first exhaust chamber dose not collide with the partitioning member, and hence the outer surface of the partitioning member cannot be overheated locally. Thus, the durability of the partitioning member can be enhanced.

According to a third feature of the present invention, in addition to the first or second feature, a second diffusing plate is disposed in the second exhaust chamber so as to guide the exhaust gas flowing through the first communication bores into the second exhaust chamber toward the third exhaust chamber, while diffusing the exhaust gas.

With the third feature of the present invention, the exhaust gas passed from the first exhaust chamber through the first communication bores into the second exhaust chamber is guided in its entirety toward the third exhaust chamber, while being diffused by the second diffusing plate. Therefore, the exhaust gas can be brought into contact with all over the outer surface of the partitioning member carrying the catalyst and facing the second exhaust chamber, whereby the exhaust gas can be purified again. Thereafter, the exhaust gas can be passed through the second communication bores smoothly into the third exhaust chamber, leading to an enhancement in exhaust gas purifying efficiency.

According to a fourth feature of the present invention, in addition to the first feature, an inner surface of the exhaust outlet pipe does not carry the exhaust emission control catalyst.

With the fourth feature of the present invention, it is possible to minimize the rise of the temperature of the exhaust gas passed through the exhaust outlet pipe, thereby preventing an influence of the exhaust gas to the adjacent devices.

The above and other objects, features and advantages of the invention will become apparent from the following description of the preferred embodiment taken in conjunction with the accompanying drawings.

DETAILED DESCRIPTION OF PREFERRED EMBODIMENT

Figure 1:
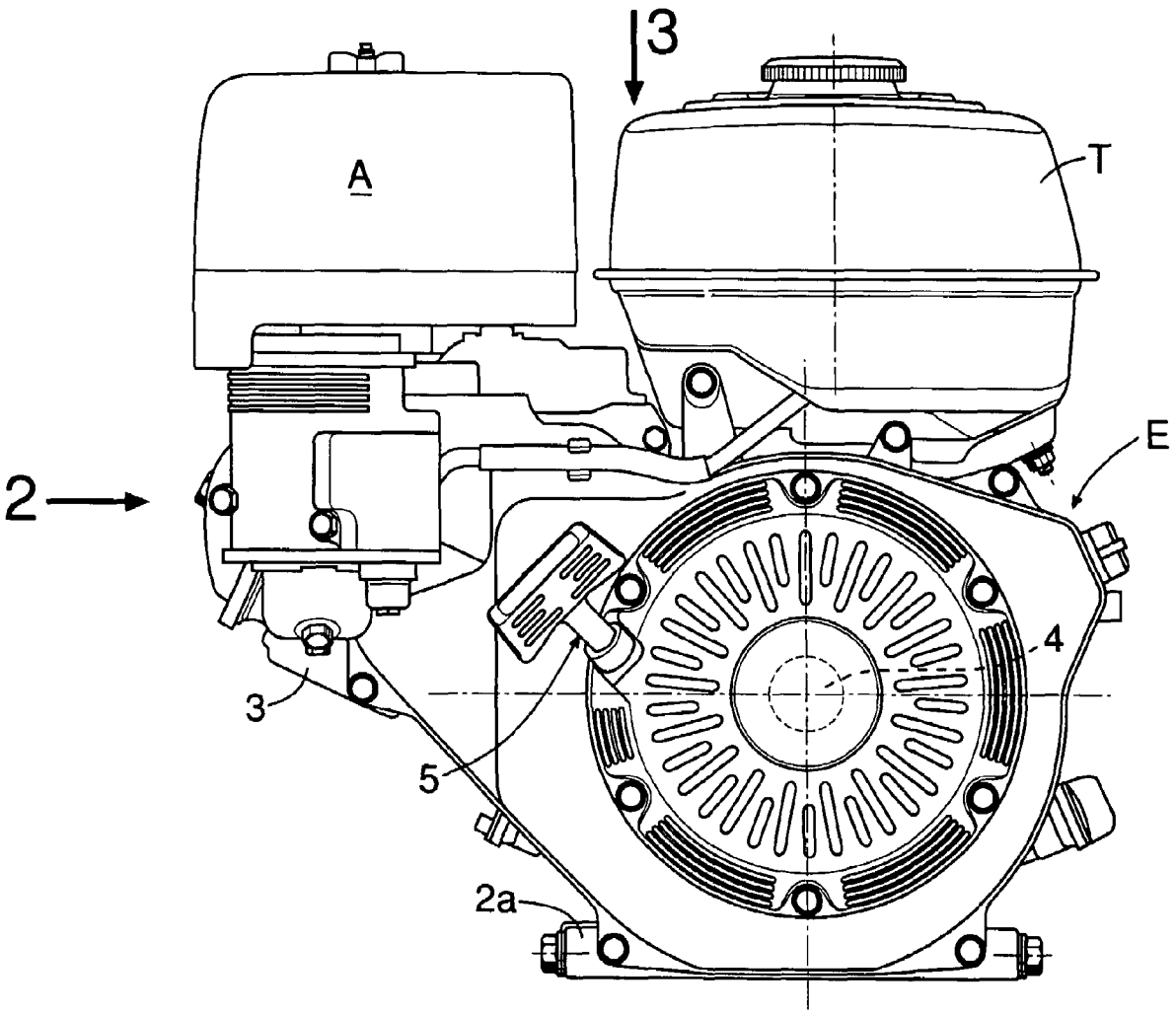
FIG. 1 is a front view of a general-purpose engine provided with an exhaust muffler according to the present invention.
Figure 2:
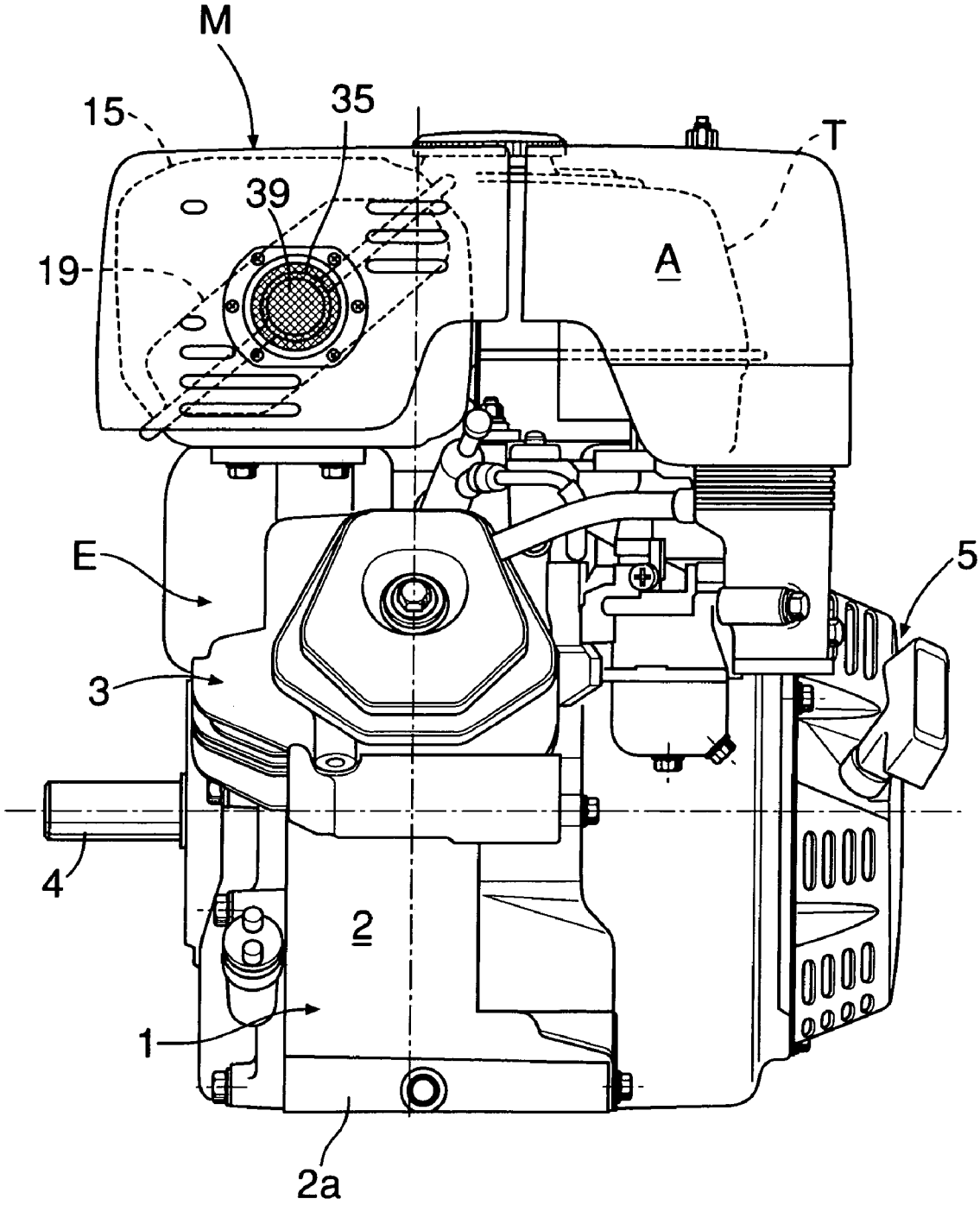
FIG. 2 is a view taken in a direction of an arrow 2 in FIG. 1.
Figure 3:
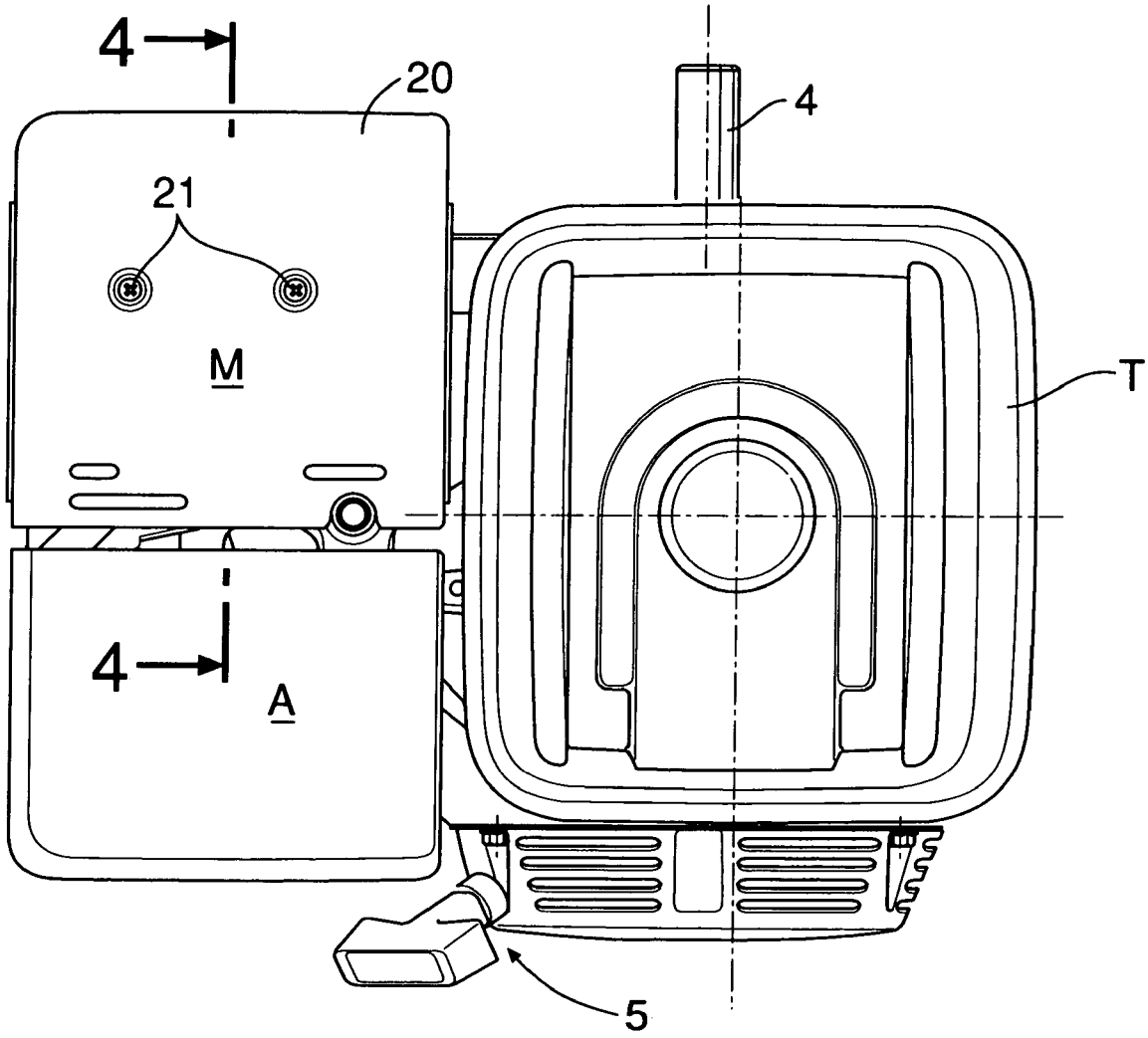
FIG. 3 is a view taken in a direction of an arrow 3 in FIG. 1.

Referring first to FIGS. 1 to 3, an engine body 1 of a general-purpose engine E comprises a crankcase 2 which has a mounting flange 2*a* on its lower surface and which carries a crankshaft 4 horizontally, and a cylinder 3 protruding obliquely upwards from one side of the crankcase 2. A recoil engine stator 5 for cranking the crankshaft 4 is mounted on a front surface of the crankcase 2. Mounted to the engine body 1 are a fuel tank T disposed above the crankcase 2, and an intake air cleaner A and an exhaust muffler M which are adjacent to the fuel tank T above the cylinder 3.

Figure 4:
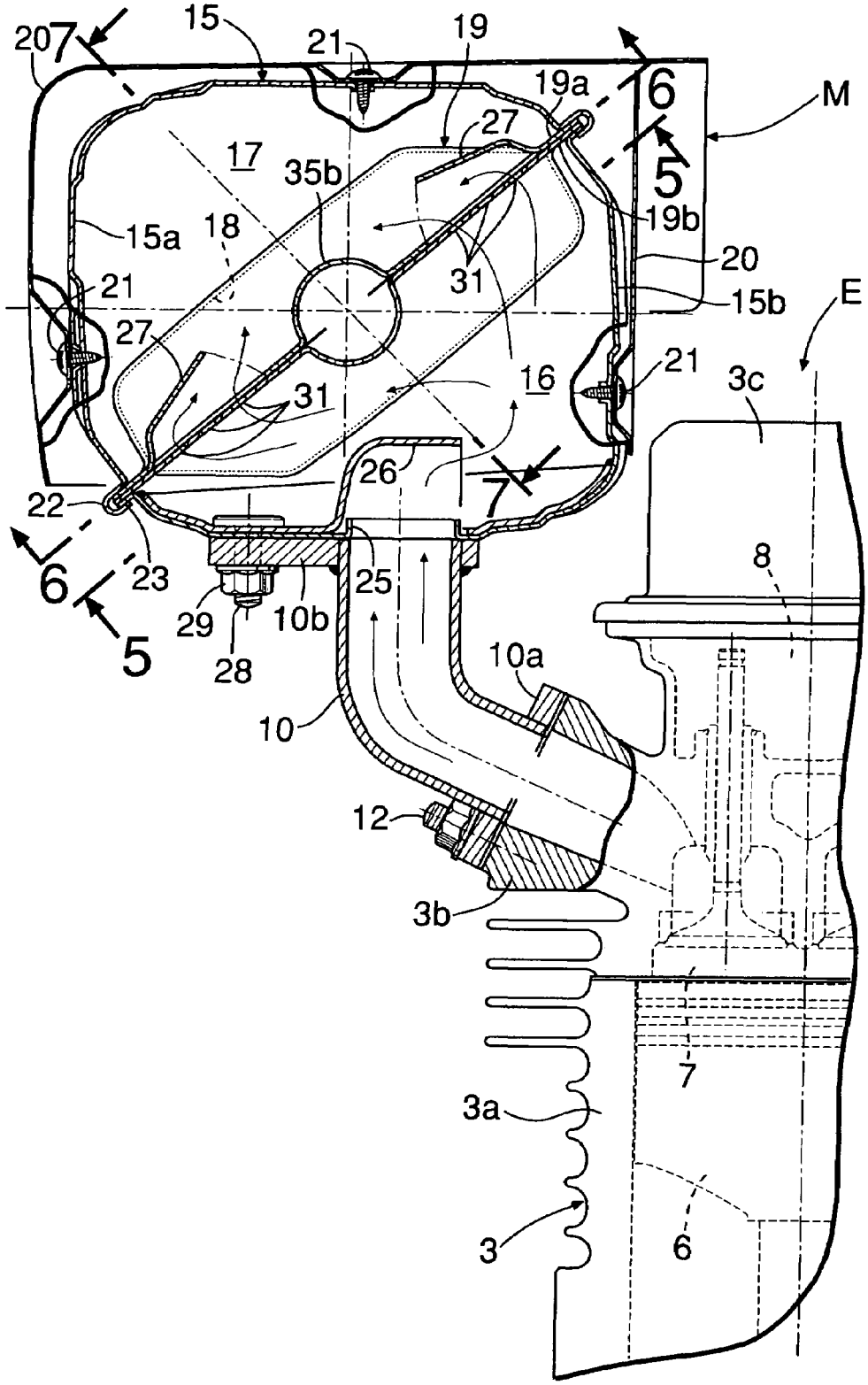
FIG. 4 is a sectional view of a portion of the engine and the exhaust muffler, taken along a line 4-4 in FIG. 3.

Referring to FIG. 4, the cylinder 3 comprises a cylinder block 3*a* connected to the crankcase 2, a cylinder head 3*b* having a combustion chamber 7 faced by a piston 6 within the cylinder block 3*a*, and a head cover 3*c* coupled to the cylinder head 3*b* to define a valve-operating chamber 8 between the head cover 3*c* and the cylinder head 3*b*. A connecting flange 10*a* at a lower end of an exhaust pipe 10 communicating with an exhaust port 9 leading to the combustion chamber 7 is secured to the cylinder head 3*b* by a bolt 12. The exhaust muffler M is connected to the exhaust pipe 10.

The exhaust muffler M will be described below with reference to FIGS. 4 to 8.

Figure 5:
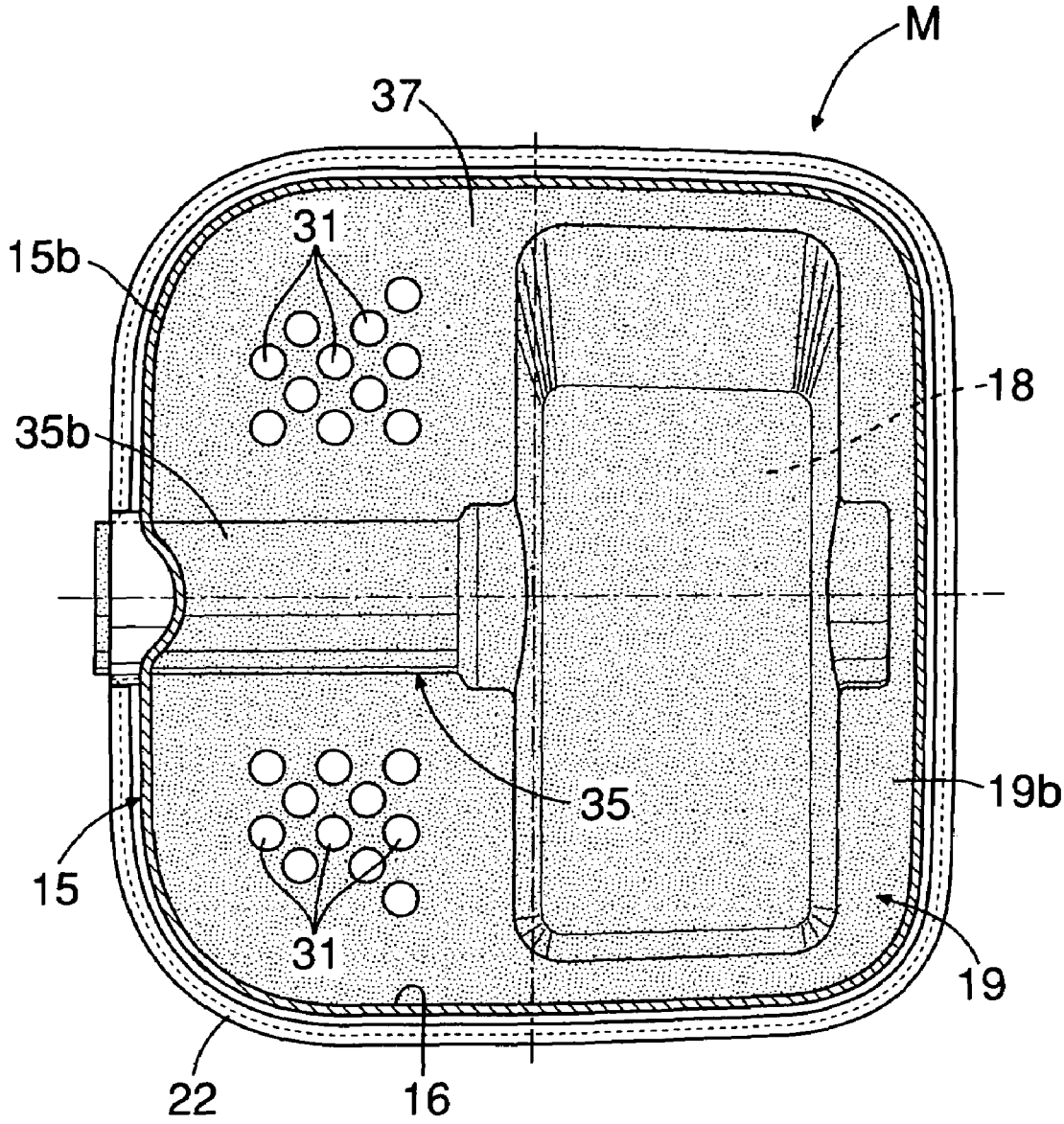
FIG. 5 is a sectional view taken along a line 5-5 in FIG. 4.
Figure 6:
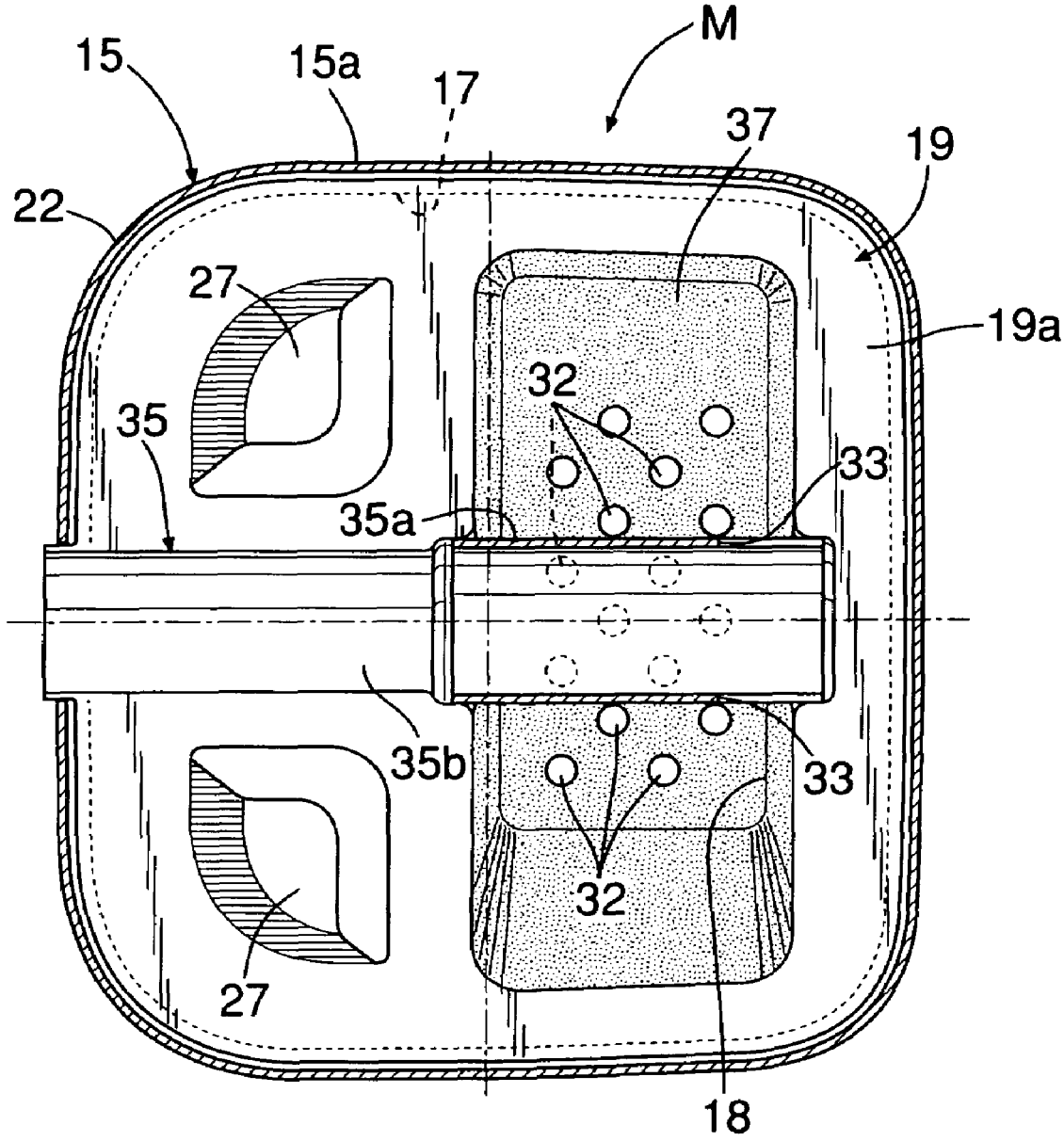
FIG. 6 is a sectional view taken along a line 6-6 in FIG. 4.
Figure 7:
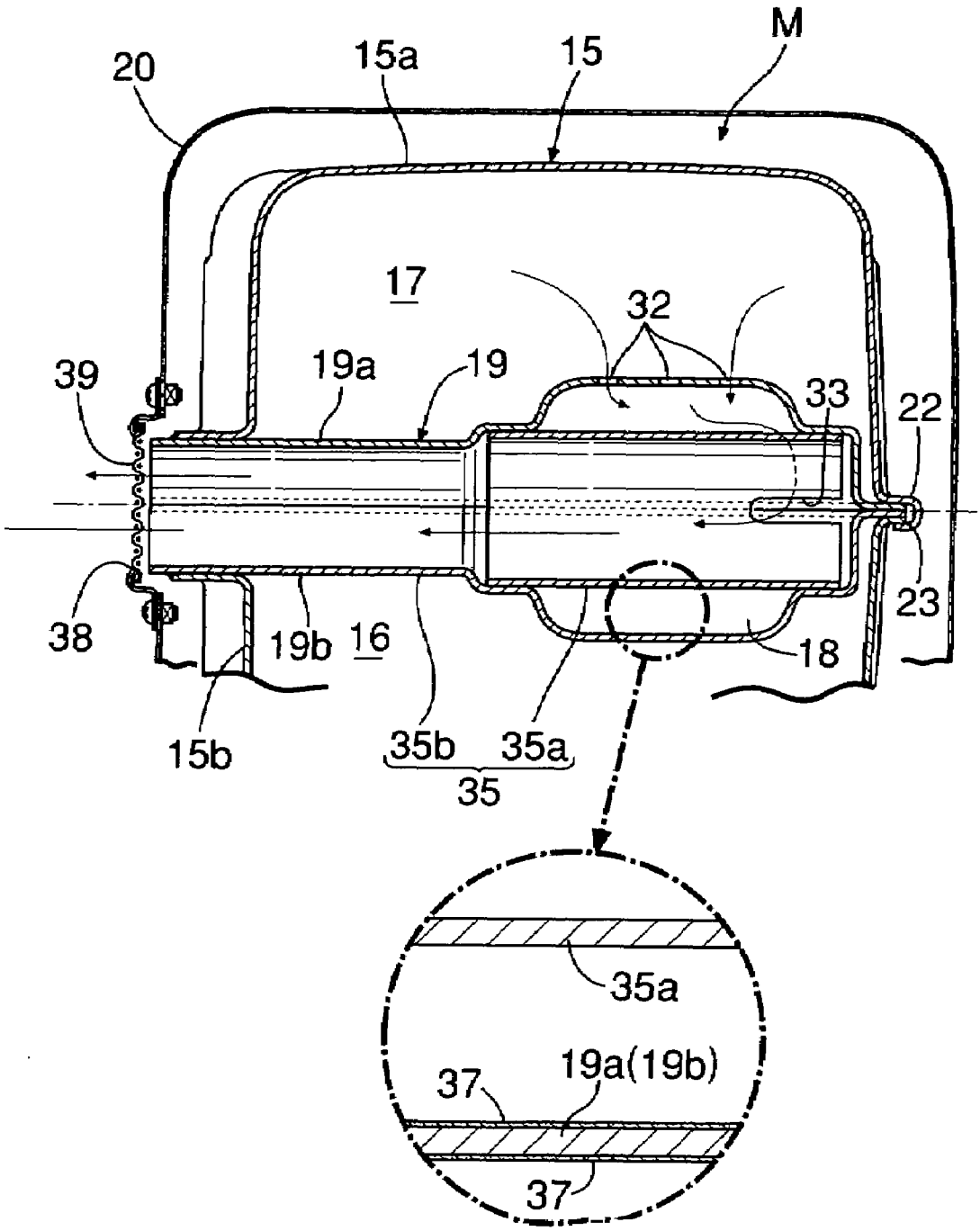
FIG. 7 is a sectional view taken along a line 7-7 in FIG. 4.
Figure 8:
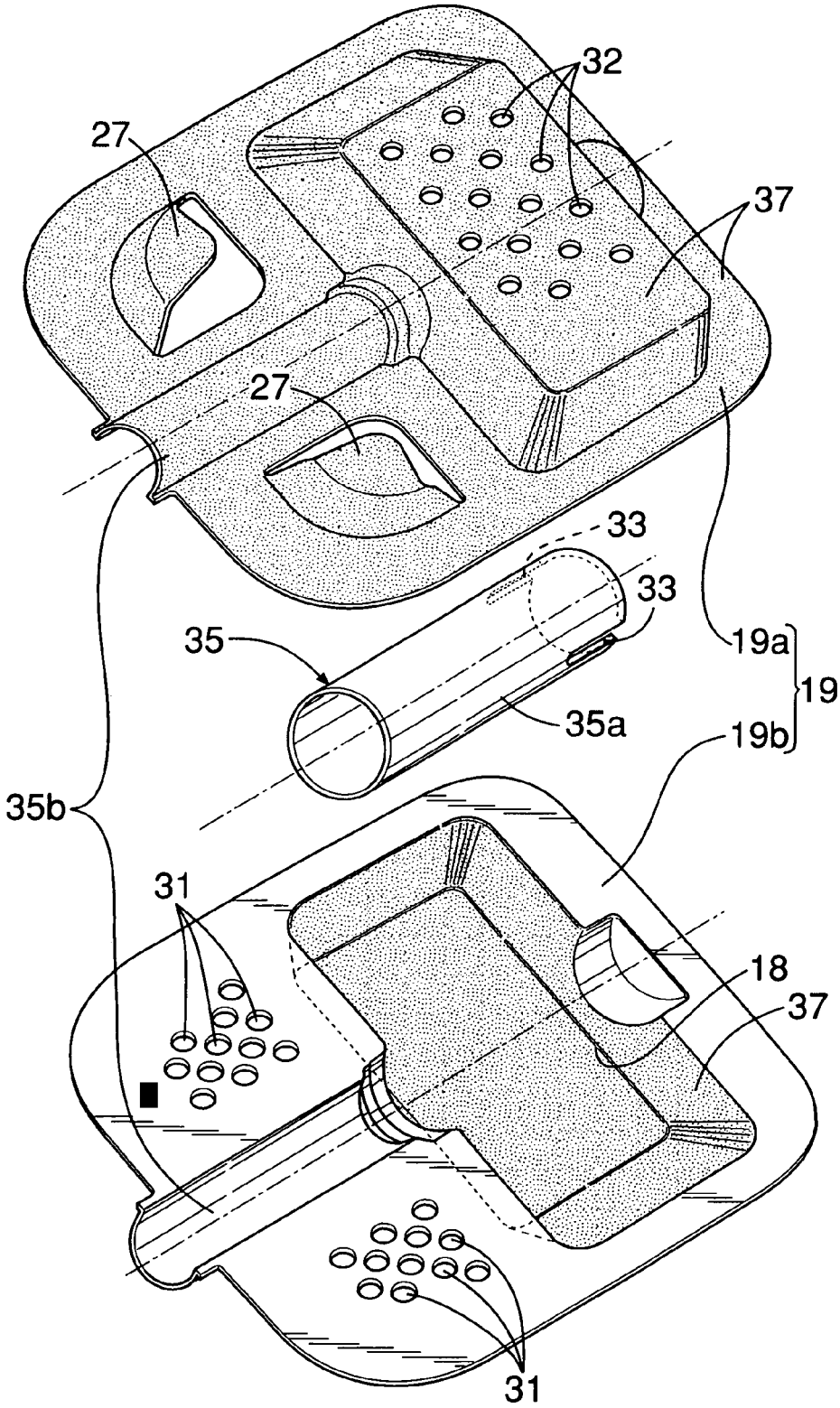
FIG. 8 is an exploded perspective view of a partitioning member in the exhaust muffler.

Referring to FIGS. 4 and 5, the exhaust muffler M comprises: a box-shaped muffler body 15; a partitioning member 19 disposed along a single diagonal line within the muffler body 15 to divide the inside of the muffler body 15 into a first exhaust chamber 16 and a second exhaust chamber 17; and a muffler cover 20 which is made of a synthetic rein or a steel plate and which is secured to the muffler body 15 by a plurality of tapping screws 21 to cover an outer surface of the muffler body 15 excluding a lower surface on the side of the exhaust pipe 10.

The muffler body 15 comprises a lower muffler half 15*b* and an upper muffler half 15*a* both made of a steel plate and formed by division of the muffler body 15 along a single diagonal line. The muffler halves 15*a* and 15*b* are coupled to each other by crimping a crimping portion 22 around an outer periphery of the upper muffler half 15*a* to a flange 23 around an outer periphery of the lower muffler half 15*b*. At this time, the partitioning member 19 is coupled to the muffler body 15 by clamping an outer peripheral portion of the partitioning member 19 between the crimping portion 23 and the flange 23.

As shown in FIG. 4, the lower muffler half 15*b* is provided with an exhaust inlet 25 which permits the exhaust pipe 10 to open into the first exhaust chamber 16. A first diffusing plate 26 is coupled to an inner wall of the lower muffler half 15*b* to cover the exhaust inlet 25 and become a shielding between the exhaust inlet 25 and the partitioning member 19, so that exhaust gas flowing through the exhaust inlet 25 into the first exhaust chamber 16 is diffused by the first diffusing plate 26 and prevented from colliding with the partitioning member 19.

A connecting bolt 28 passed through the lower muffler half 15*b* is welded to the first diffusing plate 26. The first diffusing plate 26 and the muffler half 15*b* are secured to a connecting flange 10*b* at an upper end of the exhaust pipe 10 by the connecting bolt 28 and a nut 29 threadedly fitted over the connecting bolt 28. In this manner, the first diffusing plate 26 also serves as a reinforcing plate for the lower muffler half 15*b*.

As shown in FIGS. 5 to 8, the partitioning plate 19 comprises an upper partitioning half 19*a* and a lower partitioning half 19*b* which are made of a steel plate and coupled to each other. Two sets of first communication bores 31 are provided in one half of the lower partitioning half 19*b* and arranged at distances from one another. The first and second exhaust chambers 16 and 17 are permitted to communicate with each other by the first communication bores 31. On the other hand, a pair of second diffusing plates 27, 27 are formed by cutting and raising portions in one half of the upper partitioning plate 19*a*, and disposed to cover the two sets of first communication bores 31 and guide the exhaust gas flowing through the first communication bores 31 into the second exhaust chamber 17 toward a third exhaust chamber 18 which will be described below.

The third exhaust chamber 18 is defined between the other half portions of the partitioning halves 19*a* and 19*b* by bulging the other half portions outwards. Second communication bores 32 are provided in the upper partitioning half 19*a* to permit communication of the second exhaust chamber 17 with the third exhaust chamber 18.

The third exhaust chamber 18 opens to the atmosphere through an exhaust outlet pipe 35 passed through the two sets of the first communication bores 31.

The exhaust outlet pipe 35 comprises a pipe member 35*a* supported between the upper and lower partitioning halves 19*a* and 19*b* to traverse the third exhaust chamber 18, and a pipe-shaped portion 35*b* formed by bulging between the upper and lower partitioning halves 19*a* and 19*b* to communicate with the pipe member 35*a*. The pipe-shaped portion 35*b* is disposed to extend through between the two sets of the first communication bores 31 and through between joint surfaces of the upper and lower muffler halves 15*a* and 15*b* to protrude to the outside. A single or a plurality of notch-shaped third communication bores 33 is or are provided in one end of the pipe member 35*a* to permit the communication of the third exhaust chamber 18 with the exhaust outlet pipe 35.

Thus, an exhaust emission control catalyst 37 is carried on an outer surface of the partitioning member 19 facing the first and second exhaust chambers 16 and 17, as well as on an inner surface of the partitioning member 19 facing the third exhaust chamber 18, while an inner surface of the muffler body 15 and the exhaust outlet pipe 35 do not carry the exhaust emission control catalyst 37. The exhaust emission control catalyst 37 comprises platinum (Pt) or palladium (Pd) as an oxidizing catalyst, and rhodium (Rh) as a reducing catalyst. Therefore, HC and CO in the exhaust gas are oxidized by the oxidizing catalyst, and NOx in the exhaust gas is reduced by the reducing catalyst.

A through-hole 38 is provided in the muffler cover 20 to face an opening in an outer end of the exhaust outlet pipe 35. Also a spark arrestor 39 made of a metal mesh is mounted to the muffler cover 20 to extend across the through-hole 38.

The operation of the present embodiment will be described below.

At an exhaust stroke of the engine E, the exhaust gas discharged from the combustion chamber 7 flows sequentially through the exhaust port 9, the exhaust pipe 10 and the exhaust inlet 25 into the first exhaust chamber 16. At this time, the exhaust gas is diffused over the entire first exhaust chamber 16 by collision with the first diffusing plate 26 without colliding with the partitioning member 19. As a result, the exhaust gas is brought into contact with all over the outer surface of the partitioning plate 19 carrying the catalyst 37 and facing the first exhaust chamber 16, whereby the exhaust gas is effectively purified. Moreover, the exhaust gas flowing through the exhaust inlet 25 into the first exhaust chamber 16 cannot directly collide with the partitioning plate 19 and hence, the outer surface of the partitioning plate 19 cannot be locally overheated. Thus, the durability of the partitioning plate 19 can be enhanced.

The exhaust gas purified in the first exhaust chamber 16 is passed through the two sets of the first communication bores 31 into the second exhaust chamber 17. At this time, the entirety of the exhaust gas is guided toward the third exhaust chamber 18, while being diffused by the pair of the second diffusing plates 27, 27. As a result, the exhaust gas is brought into contact with all over the outer surface of the partitioning plate 19 carrying the catalyst 37 and facing the second exhaust chamber 17, whereby the exhaust gas is purified again, and thereafter it can be passed smoothly into the third exhaust chamber 18 through the second communication bores 32. Then, the exhaust gas is brought into contact with the inner surface of the partitioning plate 19 carrying the catalyst 37, which faces the third exhaust chamber 18, whereby the exhaust gas is further purified. Thereafter, the exhaust gas is discharged from the third communication bore 33 via the exhaust outlet pipe 35 to the atmosphere.

In this manner, the exhaust gas is subjected stepwise to purifying reactions on the outer and inner surfaces of the partitioning plate 19, while being moved sequentially through the first to third exhaust chambers 16 to 18. Therefore, both the rise of the temperature of the exhaust gas and the rise of the temperature of the partitioning plate 19 itself due to purifying reaction heat are relatively small. Further, because the inner surface of the muffler body 15 is formed as the surface which does not carry the exhaust emission control catalyst, the overheating of the muffler body 15 can be avoided. Therefore, it is possible to avoid thermal damages to the adjacent devices such as the fuel tank T, by mounting the further simple muffler cover 20 to the exhaust muffler M to cover the outer surface of the exhaust muffler M as in the case of a normal exhaust muffler. Furthermore, a honeycomb carrier or a porous carrier exclusively used to carry the catalyst is not used, and hence the structure is remarkably simple and inexpensive.

Further, because the inner surface of the exhaust outlet pipe 35 permitting the third exhaust chamber 18 to open to the atmosphere is also formed as the surface which does not carry the exhaust emission control catalyst, the rise of the temperature of the exhaust gas passed through the exhaust outlet pipe 35 can be minimized, and thus the durability of the spark arrestor 38 can be ensured, and the influence to the adjacent devices by the exhaust gas can be prevented.

Yet further, by setting the length of the exhaust outlet pipe 35 at a suitable value corresponding to a normal rotational speed of the engine E, the external air can be drawn into the third to first exhaust chambers 18 to 16 by effectively utilizing the pulsation of the exhaust gas from the engine E, and therefore it is possible to provide an enhancement in exhaust gas purifying performance by the oxidizing reaction.

In addition, noise of the exhaust gas is silenced by a damping effect provided by the expansion of the exhaust gas while the exhaust gas is sequentially passing through the first exhaust chamber 16 to the third exhaust chamber 18.

Further, the exhaust emission control catalyst 37 carried on the outer and inner surfaces of the partitioning plate 19 little obstruct the flowing of the exhaust gas, and hence an increase in back pressure can be suppressed to minimize a loss in output from the engine E. Therefore, the exhaust muffler M is suitable for use in a general-purpose engine having a small displacement.

Although the embodiment of the present invention has been described in detail, the present invention is not limited to the above-described embodiment, and various modifications in design may be made without departing from the subject matter of the invention defined in the claims.

What is claimed is:

1. An exhaust muffler with an exhaust emission control function, comprising:

a hollow muffler body;

a partitioning member dividing the inside of the muffler body into a first exhaust chamber and a second exhaust chamber;

a third exhaust chamber formed in the partitioning member;

an exhaust inlet provided in the muffler body so as to introduce exhaust gas from an engine into the first exhaust chamber;

first communication bores provided in the partitioning member so as to provide communication between the first exhaust chamber and the second exhaust chamber;

second communication bores provided in the partitioning member so as to provide communication between the second exhaust chamber and the third exhaust chamber;

an exhaust outlet pipe permitting the third exhaust chamber to open to the atmosphere; and an exhaust emission control catalyst carried on an outer surface of the partitioning member facing the first and second exhaust chambers, as well as on an inner surface of the partitioning member facing the third exhaust chamber;

an inner surface of the muffler body not carrying the exhaust emission control catalyst.

2. An exhaust muffler with an exhaust emission control function according to claim 1, wherein a first diffusing plate is disposed in the first exhaust chamber so as to diffuse the exhaust gas flowing through the exhaust inlet into the first exhaust chamber.

3. An exhaust muffler with an exhaust emission control function according to claim 1 or 2, wherein a second diffusing plate is disposed in the second exhaust chamber so as to guide the exhaust gas flowing through the first communication bores into the second exhaust chamber toward the third exhaust chamber, while diffusing the exhaust gas.

4. An exhaust muffler with an exhaust emission control function according to claim 1, wherein an inner surface of the exhaust outlet pipe does not carry the exhaust emission control catalyst.

5. An exhaust muffler with an exhaust emission control function according to claim 1, wherein the third exhaust chamber is positioned inside the muffler body near one of opposite lateral sides of the muffler body and said exhaust outlet pipe protrudes to an outside of the muffler body from the other lateral side of the muffler body.

* * * * *